US010540891B2

(12) United States Patent
Ashida et al.

(10) Patent No.: US 10,540,891 B2
(45) Date of Patent: Jan. 21, 2020

(54) TRAFFIC-CONGESTION PREVENTION SYSTEM, TRAFFIC-CONGESTION PREVENTION METHOD, AND RECORDING MEDIUM

(71) Applicant: NEC Corporation, Minato-ku, Tokyo (JP)

(72) Inventors: Yuta Ashida, Tokyo (JP); Itaru Nishioka, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 15/754,031

(22) PCT Filed: Aug. 27, 2015

(86) PCT No.: PCT/JP2015/004307
§ 371 (c)(1),
(2) Date: Feb. 21, 2018

(87) PCT Pub. No.: WO2017/033215
PCT Pub. Date: Mar. 2, 2017

(65) Prior Publication Data

US 2018/0211523 A1 Jul. 26, 2018

(51) Int. Cl.
*G08G 1/01* (2006.01)
*G08G 1/081* (2006.01)
*G08G 1/0967* (2006.01)

(52) U.S. Cl.
CPC ..... *G08G 1/0141* (2013.01); *G08G 1/0129* (2013.01); *G08G 1/0133* (2013.01); *G08G 1/081* (2013.01); *G08G 1/096775* (2013.01)

(58) Field of Classification Search
CPC .... G06Q 50/30; G08G 1/0112; G08G 1/0116; G08G 1/0129; G08G 1/0133;
(Continued)

(56) References Cited

U.S. PATENT DOCUMENTS 5,646,853 A 7/1997 Takahashi et al.
8,437,948 B1 5/2013 Balasundaram et al.
(Continued)

FOREIGN PATENT DOCUMENTS

JP H05-028395 A 2/1993
JP 2000-306194 A 11/2000
(Continued)

OTHER PUBLICATIONS

Ryohei Fujimaki et al., "The Most Advanced Data Mining of the Big Data Era", NEC Technical Journal, 2012, pp. 81-85, vol. 65, No. 2, Japan, Cited in the Specification.
(Continued)

*Primary Examiner* — Omeed Alizada

(57) ABSTRACT

A traffic-congestion prevention system for preventing traffic congestion at a target location at a target time more certainly is provided. The traffic-congestion prevention system 10 includes a traffic state calculation unit 124 and a display control unit 16. The traffic state calculation unit 124 calculates a target traffic state that is a traffic state to be achieved at a location different from the target location in order to prevent traffic congestion at the target location at the target time. The display control unit 16 controls display means in such a way that the target traffic state at the location is displayed on the display means.

15 Claims, 18 Drawing Sheets

(58) Field of Classification Search
CPC ..... G08G 1/0141; G08G 1/0145; G08G 1/07; G08G 1/081; G08G 1/09; G08G 1/095; G08G 1/096716; G08G 1/096725; G08G 1/096775
See application file for complete search history.

(56) References Cited

U.S. PATENT DOCUMENTS

| | | | | |
|---|---|---|---|---|
| 9,819,781 | B1 * | 11/2017 | Brand | B61L 27/0005 |
| 2012/0059574 | A1 * | 3/2012 | Hada | G08G 1/0112 701/119 |
| 2013/0103294 | A1 * | 4/2013 | Koshizen | B60K 37/02 701/118 |
| 2013/0124012 | A1 | 5/2013 | Shida et al. | |
| 2013/0268174 | A1 | 10/2013 | Koshizen | |
| 2014/0172521 | A1 | 6/2014 | Itaya et al. | |

FOREIGN PATENT DOCUMENTS

| | | | |
|---|---|---|---|
| JP | 2000-339584 | A | 12/2000 |
| JP | 2002-342872 | A | 11/2002 |
| JP | 2008-065633 | A | 3/2008 |
| JP | 2012-073981 | A | 4/2012 |
| WO | 2010/098128 | A1 | 9/2010 |
| WO | 2012/081208 | A1 | 6/2012 |
| WO | 2013/018656 | A1 | 2/2013 |

OTHER PUBLICATIONS

Riki Eto et al., "Fully-Automatic Bayesian Piecewise Sparse Linear Models", Proceedings of the 17th International Conference on Artificial Intelligence and Statistics (AISTATS), 2014, pp. 238-246, vol. 33, Reykjavik, Iceland, Cited in the Specification.
International Search Report for PCT Application No. PCT/JP2015/004307, dated Nov. 24, 2015.
English translation of Written opinion for PCT Application No. PCT/JP2015/004307.
Japanese Office Action for JP Application No. 2017-536061 dated Feb. 5, 2019 with English Translation.

* cited by examiner

Fig.6

| PREDICTION LOCATION | PREDICTION TIME | PREDICTION MODEL |
|---|---|---|
| X1 | 0.5 HOURS LATER(T=0.5h) | $\rho'_1(t+0.5h)=\cdots$ |
| | 1 HOUR LATER(T=1h) | $\rho'_1(t+1h)=\cdots$ |
| | 1.5 HOURS LATER(T=1.5h) | $\rho'_1(t+1.5h)=\cdots$ |
| | 2 HOURS LATER(T=2h) | $\rho'_1(t+2h)=\cdots$ |
| | : | : |
| X2 | 0.5 HOURS LATER(T=0.5h) | $\rho'_2(t+0.5h)=\cdots$ |
| | 1 HOUR LATER(T=1h) | $\rho'_2(t+1h)=\cdots$ |
| | 1.5 HOURS LATER(T=1.5h) | $\rho'_2(t+1.5h)=\cdots$ |
| | 2 HOURS LATER(T=2h) | $\rho'_2(t+2h)=\cdots$ |
| | : | : |
| : | : | : |

Fig.7

| PREDICTION EXECUTION TIME | TRAFFIC CONGESTION OCCURRENCE | TRAFFIC-CONGESTION PREDICTION TIME | TRAFFIC-CONGESTION PREDICTION LOCATION |
|---|---|---|---|
| : | : | : | : |
| 2015/08/01 09:50 | NO | — | — |
| 2015/08/01 10:00 | YES | 2015/08/01 12:00 | X6 |
| : | : | : | : |

Fig.9

| LOCATION | COST INFORMATION | TRAFFIC STATE CONTROLLABLE VOLUME (VEHICLE DENSITY [NUMBER OF VEHICLES/km]) | |
|---|---|---|---|
| | | MAXIMUM VALUE | MINIMUM VALUE |
| X1 | $c_1$=0.25 | 100 | 10 |
| X2 | $c_2$=0.50 | 200 | 20 |
| X3 | $c_2$=0.40 | 150 | 10 |
| ⋮ | ⋮ | ⋮ | ⋮ |

Fig.10

| LOCATION | CONTROL MEANS TYPE | CONTROL CHARACTERISTICS | COST INFORMATION |
|---|---|---|---|
| X1 | NUMBER OF GATES OF TOLL BOOTH | NUMBER OF GATES=1: NUMBER OF PASSING VEHICLES 5 VIHICLES/MIN<br>NUMBER OF GATES=2: NUMBER OF PASSING VEHICLES 10 VIHICLES/MIN<br>: | 100/GATE INCREASE, DECREASE |
| X2 | DRIVING SUPPORT LAMPS | LIGHTING PATTERN A: VEHICLE SPEED 100 km/h<br>LIGHTING PATTERN B: VEHICLE SPEED 90 km/h<br>: | 10/PATTERN SWITCHING |
| X3 | GUIDANCE TO SERVICE AREA | PRESENTATION INFORMATION A: 10% USED<br>PRESENTATION INFORMATION B: 20% USED<br>: | 1/PRESENTATION INFORMATION SWITCHING |
| : | : | : | : |

Fig.11

| LOCATION | TARGAT TRAFFIC STATE (VEHICLE DENSITY [NUMBER OF VEHICLES/km]) |
|---|---|
| X1 | 50 |
| X2 | 40 |
| X3 | 35 |
| ⋮ | ⋮ |

Fig.15

| LOCATION | TARGET TRAFFIC STATE (VEHICLE DENSITY [NUMBER OF VEHICLES/km]) | CONTROL PATTERN |
|---|---|---|
| X1 | 50 | NUMBER OF GATES=2 |
| X2 | 40 | LIGHTING PATTERN A |
| X3 | 35 | PRESENTATION INFORMATION A |
| ⋮ | ⋮ | ⋮ |

Fig.16

181

| CONTROL EXECUTION TIME | 2015/08/01 11:00 |
|---|---|

| CONTROL EXECUTION TIME | 2015/08/01 10:30 |
|---|---|

| CONTROL EXECUTION TIME | 2015/08/01 10:00 |
|---|---|

| TRAFFIC-CONGESTION PREDICTION TIME | 2015/08/01 12:00 |
|---|---|
| TRAFFIC-CONGESTION PREDICTION LOCATION | X6 |

CONTROL PATTERN

| LOCATION X1 | LOCATION X2 | LOCATION X3 | ... |
|---|---|---|---|
| NUMBER OF GATES=2 | LIGHTING PATTERN A | PRESENTATION INFORMATION A | ... |

TARFET TRAFFIC STATE (VECHICLE DENSITY [NUMBER OF VEHICLES/km])

| LOCATION X1 | LOCATION X2 | LOCATION X3 | ... |
|---|---|---|---|
| 50 | 40 | 35 | ... |

TRAFFIC STATE MEASUREMENT VALUE (VECHICLE DENSITY [NUMBER OF VEHICLES/km])

| COLLECTION TIME | LOCATION X1 | LOCATION X2 | LOCATION X3 | ... |
|---|---|---|---|---|
| 2015/08/01 10:00 | 60 | 50 | 40 | ... |
| 2015/08/01 10:10 | 55 | 46 | 39 | ... |
| 2015/08/01 10:20 | 53 | 44 | 38 | ... |
| ⋮ | ⋮ | ⋮ | ⋮ | ⋮ |

TRAFFIC-CONGESTION PREVENTION SYSTEM, TRAFFIC-CONGESTION PREVENTION METHOD, AND RECORDING MEDIUM

This application is a National Stage Entry of PCT/JP2015/004307 filed on Aug. 27, 2015, the contents of all of which are incorporated herein by reference, in their entirety.

TECHNICAL FIELD

The present invention relates to a traffic-congestion prevention system, a traffic-congestion prevention method, and a recording medium.

BACKGROUND ART

Various techniques for suppressing a traffic volume of vehicles including ordinary automobiles, large-size automobiles (buses, tracks, and the like), and the like, and preventing traffic congestion have been developed.

For example, PTL 1 discloses one example of such techniques for preventing traffic congestion. A traveling support device described in PTL 1 determines a state of a traffic flow from an acceleration rate of a vehicle and an inter-vehicle distance from another vehicle, switches traveling control of the vehicle depending on the determination result, and thereby prevents transition of the traffic flow to a traffic congestion state.

Further, PTL 2 discloses another technique for preventing traffic congestion. A traffic control system described in PTL 2 detects or predicts a traffic volume around a road section where a traffic volume is locally concentrated and traffic congestion is likely to occur, such as a lane junction location. Then, the traffic control system controls traveling of a vehicle in such a way that a traffic flow of the road section does not make transition to a traffic congestion state.

As a related technique, PTL 3 discloses a technique for calculating a traffic congestion degree, based on reservation information of road use, and controlling the traffic congestion degree by setting a usage toll depending on the traffic congestion degree. Further, PTL 4 discloses a technique for determining whether road section is in a traffic congestion state, based on vehicle position information, and setting a usage toll of the road section depending on the determination result. NPL 1 and NPL 2 disclose a heterogeneous mixture learning technique for generating a prediction model for each group having the same pattern or regularity of data.

CITATION LIST

Patent Literature

[PTL 1] International Publication No. WO 2012/081208

[PTL 2] U.S. Patent Application Publication No. 2013/0124012 specification

[PTL 3] International Publication No. WO 2013/018656

[PTL 4] International Publication No. WO 2010/098128

Non Patent Literature

[NPL 1] Ryohei Fujimaki, Satoshi Morinaga, "Leading-Edge Data Mining of the Big Data Era", NEC Technical Journal, Vol. 65, No. 2, 2012, pp. 81-85

[NPL 2] Riki Eto, et al., "Fully-Automatic Bayesian Piecewise Sparse Linear Models", Proceedings of the 17th International Conference on Artificial Intelligence and Statistics (AISTATS), 2014, pp. 238-246

SUMMARY OF INVENTION

Technical Problem

In the techniques described in PTLs 1 and 2 above, in a target road section for which traffic congestion is prevented, traffic volume control is performed locally. However, according to a state of a traffic volume of a target road section, such as a case where a traffic volume flowing in the target road section markedly increases, it is difficult to perform sufficient control by such local control, and therefore it may not be possible to prevent traffic congestion.

An object of the present invention is to provide a traffic-congestion prevention system, a traffic-congestion prevention method, and a recording medium, capable of solving the above-described problems and more certainly preventing traffic congestion at a target location at a target time.

Solution to Problem

A traffic-congestion prevention system according to an exemplary aspect of the present invention includes: calculation means for calculating a target traffic state that is a traffic state to be achieved at a location different from a target location in order to prevent traffic congestion at the target location at a target time; and display control means for controlling display means in such a way that the target traffic state at the location is displayed on the display means.

A traffic-congestion prevention method according to an exemplary aspect of the present invention includes: calculating a target traffic state that is a traffic state to be achieved at a location different from a target location in order to prevent traffic congestion at the target location at a target time; and controlling display means in such a way that the target traffic state at the location is displayed on the display means.

A computer readable storage medium according to an exemplary aspect of the present invention records thereon a program causing a computer to perform a method including: calculating a target traffic state that is a traffic state to be achieved at a location different from a target location in order to prevent traffic congestion at the target location at a target time; and controlling display means in such a way that the target traffic state at the location is displayed on the display means.

A traffic-congestion prevention system according to an exemplary aspect of the present invention includes: calculation means for calculating a target traffic state that is a traffic state to be achieved at a location different from a target location in order to prevent traffic congestion at the target location at a target time; and log generation means for generating and outputting a log indicating the target traffic state at the location and a measurement value of the traffic state at the location.

A traffic-congestion prevention method according to an exemplary aspect of the present invention includes: calculating a target traffic state that is a traffic state to be achieved at a location different from a target location in order to prevent traffic congestion at the target location at a target time; and generating and outputting a log indicating the target traffic state at the location and a measurement value of the traffic state at the location.

A computer readable storage medium records thereon a program causing a computer to perform a method including:

calculating a target traffic state that is a traffic state to be achieved at a location different from a target location in order to prevent traffic congestion at the target location at a target time; and generating and outputting a log indicating the target traffic state at the location and a measurement value of the traffic state at the location.

Advantageous Effects of Invention

An advantageous effect of the present invention is to prevent traffic congestion more certainly at a target location at a target time.

BRIEF DESCRIPTION OF DRAWINGS

FIG. 6 is a diagram illustrating an example of prediction models in the first example embodiment of the present invention.

FIG. 7 is a diagram illustrating an example of traffic-congestion prediction information in the first example embodiment of the present invention.

FIG. 9 is a diagram illustrating an example of control means information in the first example embodiment of the present invention.

FIG. 10 is a diagram illustrating an example of control models in the first example embodiment of the present invention.

FIG. 11 is a diagram illustrating an example of a calculation result of target traffic states in the first example embodiment of the present invention.

FIG. 15 is a diagram illustrating an example of control information in the first example embodiment of the present invention.

FIG. 16 is a diagram illustrating an example of a state log 181 in the first example embodiment of the present invention.

DESCRIPTION OF EMBODIMENTS (First Example Embodiment)

First, a configuration of a first example embodiment of the present invention will be described.

Figure 1:
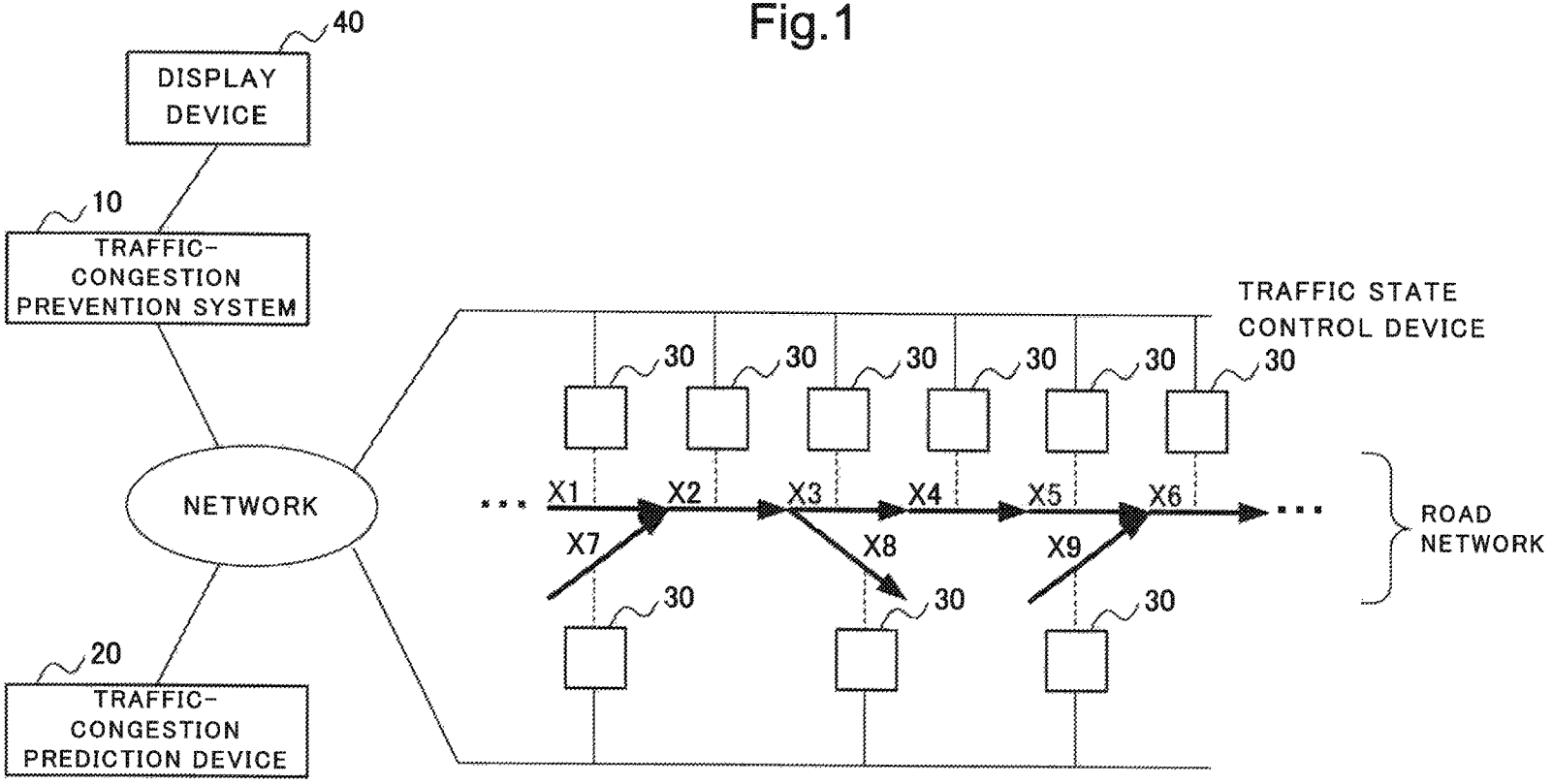
FIG. 1 is a diagram illustrating a configuration of a traffic management system in a first example embodiment of the present invention.

FIG. 1 is a diagram illustrating a configuration of a traffic management system in the first example embodiment of the present invention. Referring to FIG. 1, the traffic management system includes a traffic-congestion prevention system 10, a traffic-congestion prediction device 20, a traffic state control device 30, and a display device 40. The traffic-congestion prevention system 10, the traffic-congestion prediction device 20, and the traffic state control device 30 are mutually connected via a network or the like. Further, the display device 40 is connected to the traffic-congestion prevention system 10 via a network or the like.

The traffic state control device 30 is disposed at each of a plurality of locations (positions and sections) at which a traffic state is to be monitored and controlled on a road network. The traffic state control device 30 controls a traffic state at the location by using a traffic state control means (hereinafter, described also as a control means) included in the traffic state control device 30. In the example of FIG. 1, at each of locations X1, X2, . . . , the traffic state control device 30 is disposed.

In the first example embodiment of the present invention, as a traffic state, for example, a vehicle speed, the number of passing vehicles, a vehicle density and the like are used. Hereinafter, the traffic state is described also as a traffic flow. Further, the number of passing vehicles per unit time among the traffic states is described also as a traffic volume.

The traffic-congestion prediction device 20 predicts, based on traffic states at one or more locations, traffic congestion occurrence at respective locations.

The traffic-congestion prevention system 10 calculates traffic states (target traffic states) to be achieved at respective locations and controls traffic states at respective locations via the traffic state control devices 30 in order to prevent traffic congestion occurrence at a specific location (target location) at a specific time (target time).

Figure 2:
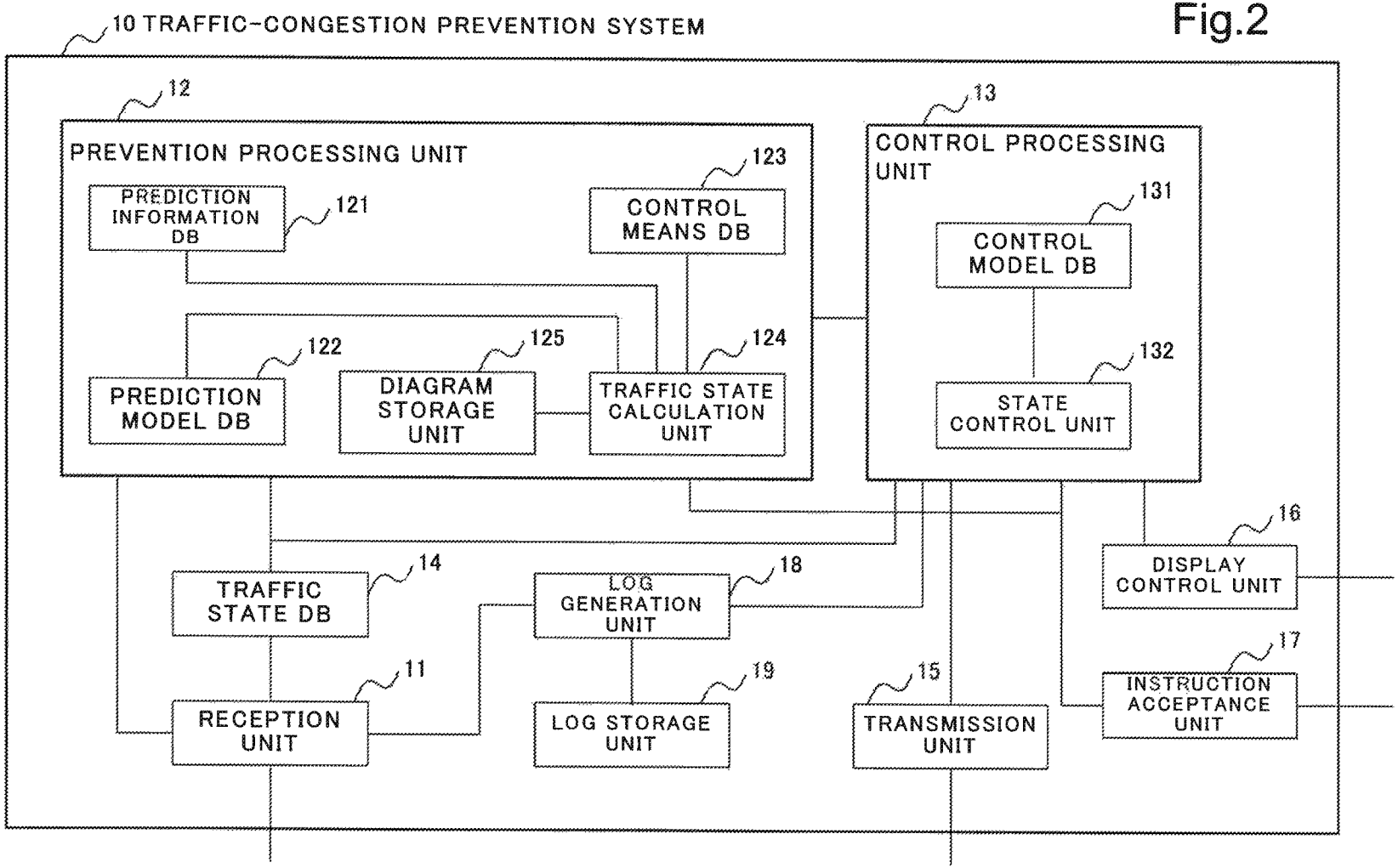
FIG. 2 is a diagram illustrating a configuration of a traffic-congestion prevention system 10 in the first example embodiment of the present invention.

FIG. 2 is a diagram illustrating a configuration of the traffic-congestion prevention system 10 in the first example embodiment of the present invention. Referring to FIG. 2, the traffic-congestion prevention system 10 includes a reception unit 11, a prevention processing unit 12, a control processing unit 13, a traffic state DB (database) 14, a transmission unit 15, a display control unit 16, an instruction acceptance unit 17, a log generation unit 18, and a log storage unit 19.

The reception unit 11 collects measurement values of traffic states at respective locations. The reception unit 11 collects the measurement values of traffic states at a predetermined collection interval, for example, by using sensors disposed at respective locations. The reception unit 11 may collect the measurement values of traffic states, based on probe data transmitted from on-board terminals. Further, the reception unit 11 may collect the measurement values of traffic states from another device such as the traffic-congestion prediction device 20.

Figure 5:
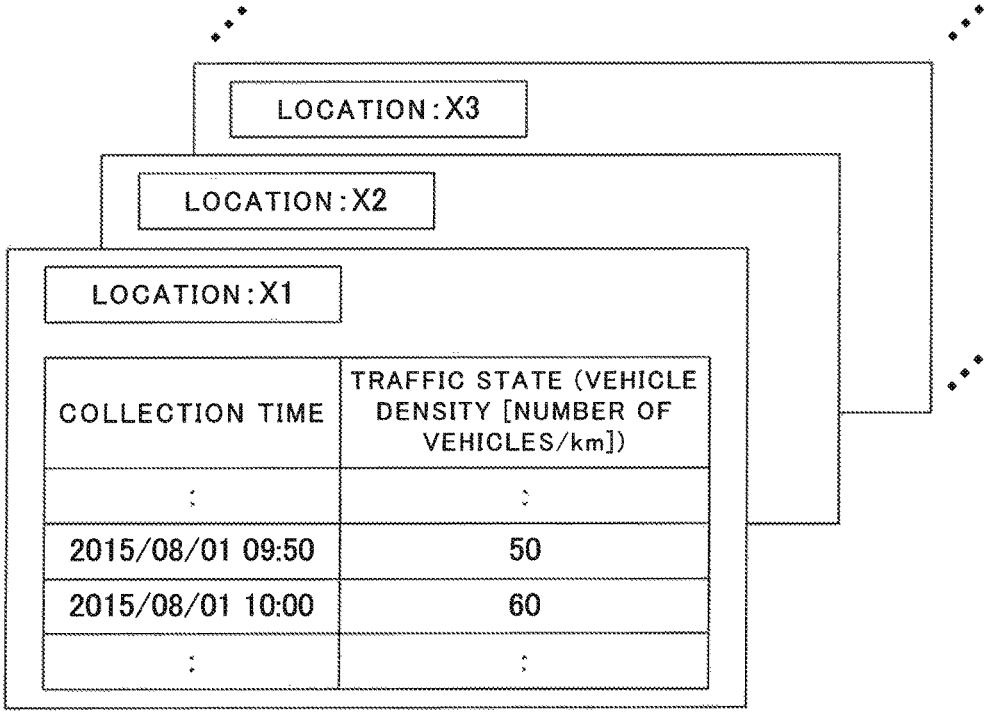
FIG. 5 is a diagram illustrating an example of traffic states in the first example embodiment of the present invention.

FIG. 5 is a diagram illustrating an example of traffic states in the first example embodiment of the present invention. In the example of FIG. 5, as a traffic state, a vehicle density at each location is collected at each collection time.

The traffic state DB 14 stores the measurement values of traffic states at respective locations collected by the reception unit 11.

The reception unit 11 further collects, from the traffic-congestion prediction device 20 or the like, prediction models (or described also as prediction equations) for predicting traffic states at respective locations. The prediction models are used for a traffic-congestion prediction.

The prediction model is a model for predicting a traffic state at a specific location (prediction location) at a specific time (prediction time) from traffic states at respective locations.

The prediction model is generated, for example, using a machine learning technique based on time series of traffic states at respective locations. For example, the prediction model may be generated using a heterogeneous mixture learning technique disclosed in NPL 1 and 2. Alternatively, the prediction model may be a general time-series model such as a linear regression model, an autoregressive model, and an autoregressive moving average model.

In the first example embodiment of the present invention, a prediction model as in equation 1 for predicting a vehicle density among the traffic states is used.

$$\rho'_j(t+T) = \sum_i \alpha_{ij}\rho_i(t) \qquad \text{[Equation 1]}$$

wherein $\rho_i(t)$ is a vehicle density at a location xi (i=1, 2, . . . , N; N is the number of locations to be monitored/controlled) at a current time t, $\rho'_j(t+T)$ is a prediction value of a vehicle density at a prediction location xj (j=1, 2, . . . , N) at a prediction time t+T, and $\alpha_{ij}$ is a parameter (weighting coefficient) by which $\rho_i(t)$ is multiplied.

FIG. 6 is a diagram illustrating an example of prediction models in the first example embodiment of the present invention. In the example of FIG. 6, for each location, prediction models of 0.5 hours later (T=0.5 h (hour)), 1 hour later (T=1 h), 1.5 hours later (T=1.5 h), 2 hours later (T=2 h), . . . are generated.

Note that, as a prediction model, without limitation to a linear function as in equation 1, any function in which traffic states are set as explanatory variables may be used. Further, for the same prediction location, a plurality of prediction models may be generated. In this case, an appropriate prediction model among these prediction models may be used according to each situation, such as weather, a day of the week, and a time zone, at a prediction time.

A prediction model DB 122 stores the prediction models collected by the reception unit 11.

The reception unit 11 further collects traffic-congestion prediction information from the traffic-congestion prediction device 20 or the like. The reception unit 11 collects the traffic-congestion prediction information, for example, at a predetermined time interval.

FIG. 7 is a diagram illustrating an example of traffic-congestion prediction information in the first example embodiment of the present invention. In the example of FIG. 7, as traffic-congestion prediction information, a time of prediction execution (prediction execution time), occurrence (YES) or non-occurrence (NO) of traffic congestion, a time for which occurrence of traffic congestion is predicted (traffic-congestion prediction time), and a location for which occurrence of traffic congestion is predicted (traffic-congestion prediction location) are indicated.

A prediction information DB 121 stores the traffic-congestion prediction information collected by the reception unit 11.

The reception unit 11 further collects fundamental diagrams for respective locations used for the traffic-congestion prediction from the traffic-congestion prediction device 20 or the like.

Figure 8:
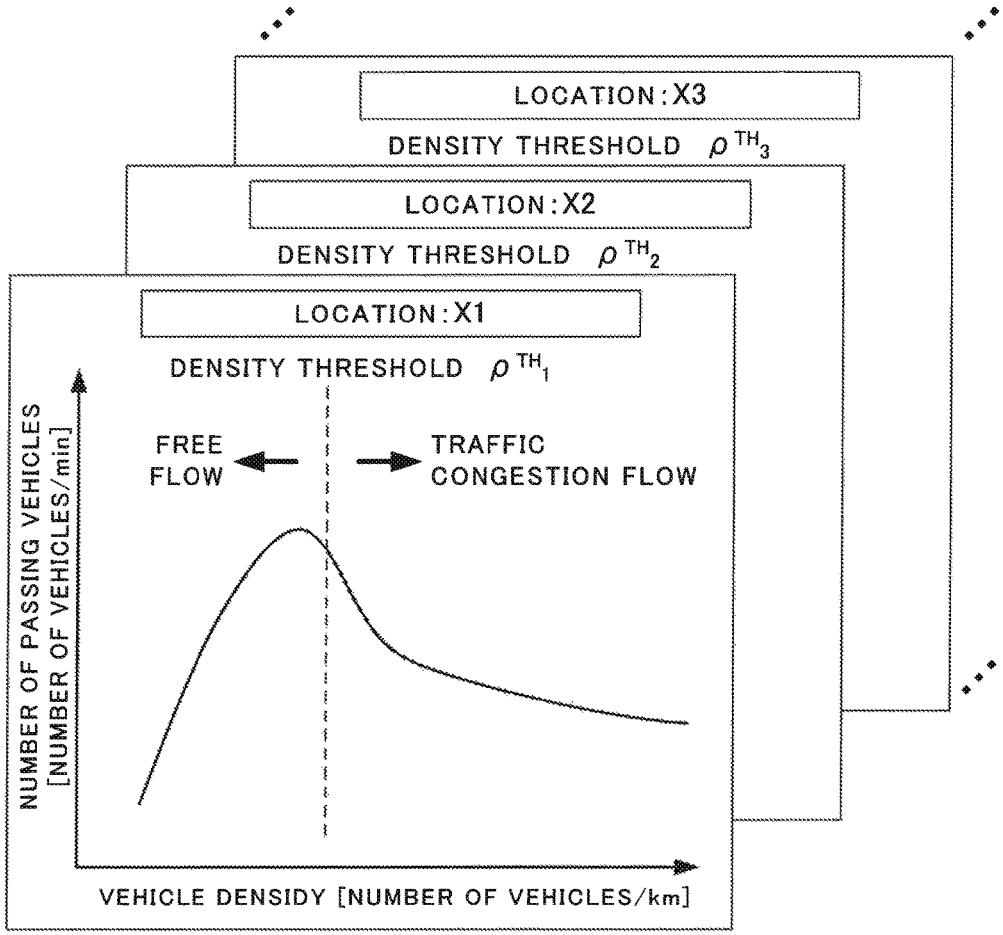
FIG. 8 is a diagram illustrating an example of fundamental diagrams in the first example embodiment of the present invention.

FIG. 8 is a diagram illustrating an example of fundamental diagrams in the first example embodiment of the present invention. The fundamental diagram is an expression method used to analyze a traffic state. The fundamental diagram is a diagram (graph) indicating a relation between a vehicle density and a vehicle speed or the number of passing vehicles at each location on a road network. When a vehicle density is specified, a vehicle speed and the number of passing vehicles at a location thereof can be estimated by the fundamental diagram. The fundamental diagram indicates that, when a vehicle density exceeds a certain value (density threshold), a vehicle speed and the number of passing vehicles decrease and a traffic flow is changed from a free flow to a traffic congestion state. In the example embodiment of the present invention, the density threshold is used as an indicator for traffic-congestion prevention.

A diagram storage unit 125 stores the fundamental diagrams for respective locations collected by the reception unit 11.

The prevention processing unit 12 includes the prediction information DB 121, the prediction model DB 122, a control means DB 123, a traffic state calculation unit 124 (or described also as a calculation unit), and the diagram storage unit 125.

The control means DB 123 stores control means information. FIG. 9 is a diagram illustrating an example of control means information in the first example embodiment of the present invention. In the control means information of FIG. 9, information (cost information) of a cost regarding a change of a traffic state performed by the traffic state control device 30 disposed at each location and a controllable volume (a maximum value and a minimum value) of the traffic state are set. In the example of FIG. 9, as cost information, a cost coefficient representing a cost for changing a traffic state by unit amount is set. Alternatively, as cost information, a cost function as described later may be set.

The control means information is used for calculating target traffic states at respective locations. The controllable volume and cost information in the control means information are set (converted) by the control processing unit 13, based on a control characteristic and cost information of a control model described later.

The traffic state calculation unit 124 calculates target traffic states at respective locations for preventing traffic congestion at the traffic-congestion prediction location at the traffic-congestion prediction time, based on traffic states at respective locations and prediction models.

The control processing unit 13 includes a control model DB 131 and a state control unit 132.

The control model DB 131 stores control models representing characteristics of control means included in the traffic state control devices 30 disposed at respective locations. FIG. 10 is a diagram illustrating an example of control models in the first example embodiment of the present invention. In the control model of FIG. 10, a type of a control means included in the traffic state control device 30 disposed at each location, a relation (control characteristic) between a control pattern by the control means and a traffic state, and information (cost information) of a cost for changing the control pattern are set. The cost include any cost representing a disadvantage caused to road management and a user when changing the control pattern, such as expenses, electric power, and necessary manpower for changing the control pattern.

The control model may be set by an operator of road management, based on specifications of the traffic state control device 30 at each location or may be set by the control processing unit 13, based on information collected from the traffic state control device 30.

The state control unit 132 generates control information for realizing the target traffic state at each location, based on the control model stored on the control model DB 131, and controls the traffic state control device 30 in such a way that a traffic state at each location becomes the target traffic state (is close to the target traffic state).

The transmission unit 15 transmits the control information generated by the control processing unit 13 to the traffic state control device 30 at each location.

The display control unit 16 controls the display device 40 in such a way that the target traffic states at respective locations and the like are displayed on the display device 40.

The instruction acceptance unit 17 accepts a modification instruction for the target traffic state at each location and the like from the display device 40.

The log generation unit 18 generates a state log 181 indicating the target traffic states and time series of measurement values of traffic states.

The log storage unit 19 stores the state log 181 generated by the log generation unit 18.

The traffic-congestion prevention system 10 may be a computer that includes a CPU (central processing unit) and a storage medium storing a program and operates by control based on the program.

Figure 3:
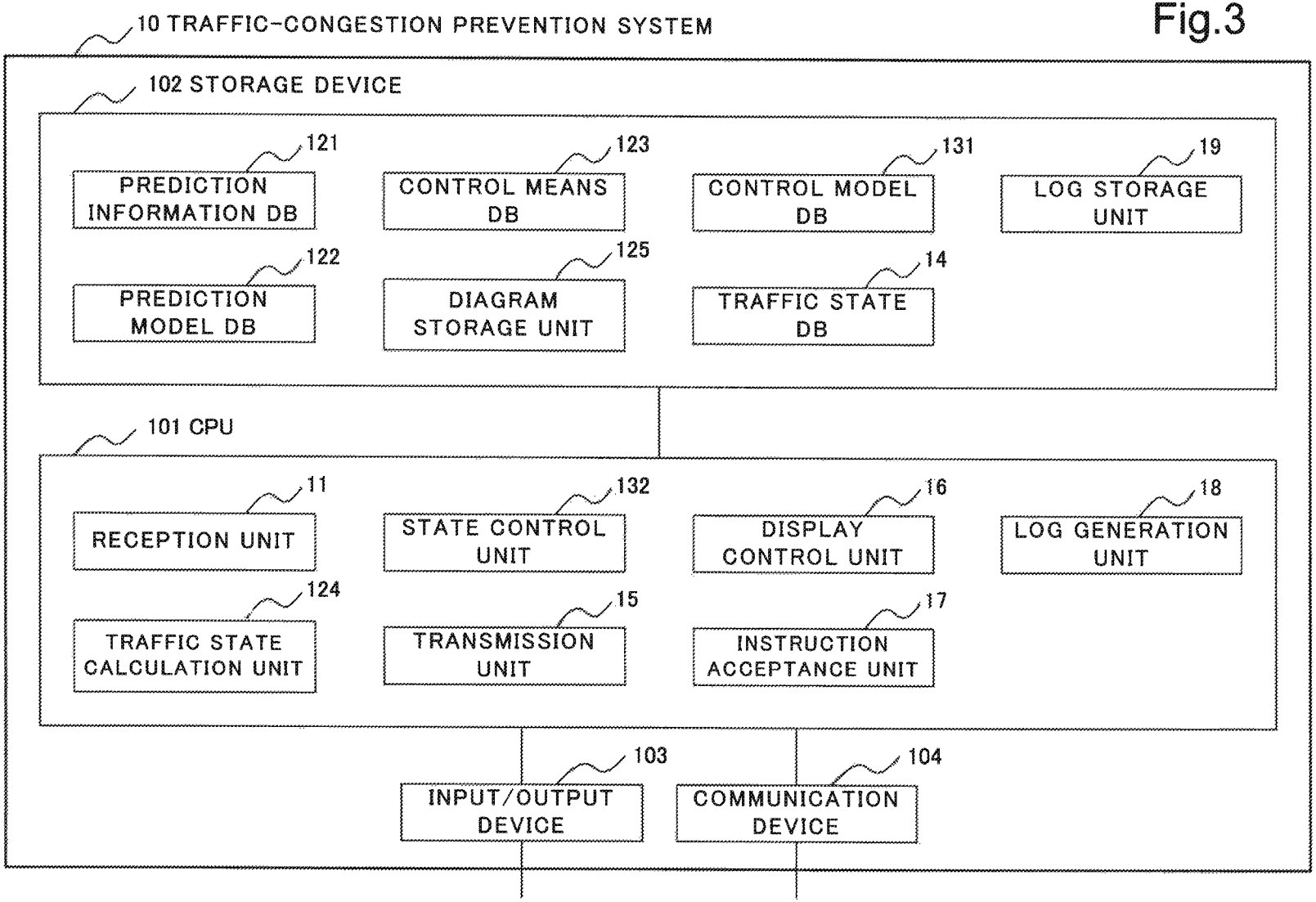
FIG. 3 is a block diagram illustrating a configuration of the traffic-congestion prevention system 10 implemented on a computer in the first example embodiment of the present invention.

FIG. 3 is a block diagram illustrating a configuration of the traffic-congestion prevention system 10 implemented on a computer in the first example embodiment of the present invention.

In this case, the traffic-congestion prevention system 10 includes a CPU 101, a storage device 102 (storage medium) such as a hard disk and a memory, an input/output device 103 such as a keyboard and a display, and a communication device 104 that communicates with another device and the like. The CPU 101 executes a program for implementing the reception unit 11, the traffic state calculation unit 124, the state control unit 132, the transmission unit 15, the display control unit 16, the instruction acceptance unit 17, and the log generation unit 18. The storage device 102 stores data of the prediction information DB 121, the prediction model DB 122, the control means DB 123, the diagram storage unit 125, the control model DB 131, the traffic state DB 14, and the log storage unit 19. The communication device 104 receives traffic-congestion prediction information, prediction models, traffic states at respective locations, and fundamental diagrams from another device and the like. Further, the communication device 104 transmits control information to the traffic state control device 30 at each location. The input/output device 103 may accept, from the operator or the like, input of the traffic-congestion prediction information, the prediction models, the traffic states at respective locations, and the fundamental diagrams. Further, the input/output device 103 may output the control information to be set in the traffic state control device 30 at each location to the operator or the like.

Alternatively, each component of the traffic-congestion prevention system 10 may be implemented on a logic circuit. In this case, a plurality of components may be implemented on one logic circuit or may be implemented on a plurality of independent logic circuits, respectively.

Alternatively, respective components of the traffic-congestion prevention system 10 may be disposed in a distributed manner in a plurality of physical devices connected with wired or wireless channels. In this case, the traffic-congestion prevention system 10 may be implemented as distributed processing executed by a plurality of computers.

Further, a service of traffic-congestion prevention by the traffic-congestion prevention system 10 may be provided to the operator as a SaaS (software as a service).

Next, the operation of the first example embodiment of the present invention will be described.

It is assumed that the traffic state control devices 30 are disposed at locations X1, X2, . . . of the road network as illustrated in FIG. 1, and the traffic states of FIG. 5 are stored on the traffic state DB 14. It is also assumed that a distance between the locations is, for example, 10 kilometers. Further, it is assumed that the prediction model DB 122, the prediction information DB 121, and the diagram storage unit 125 store the prediction models of FIG. 6, the traffic-congestion prediction information of FIG. 7, and the fundamental diagrams of FIG. 8, respectively. Further, it is assumed that the control means DB 123 and the control model DB 131 store the control means information of FIG. 9 and the control models of FIG. 10, respectively.

Figure 4:
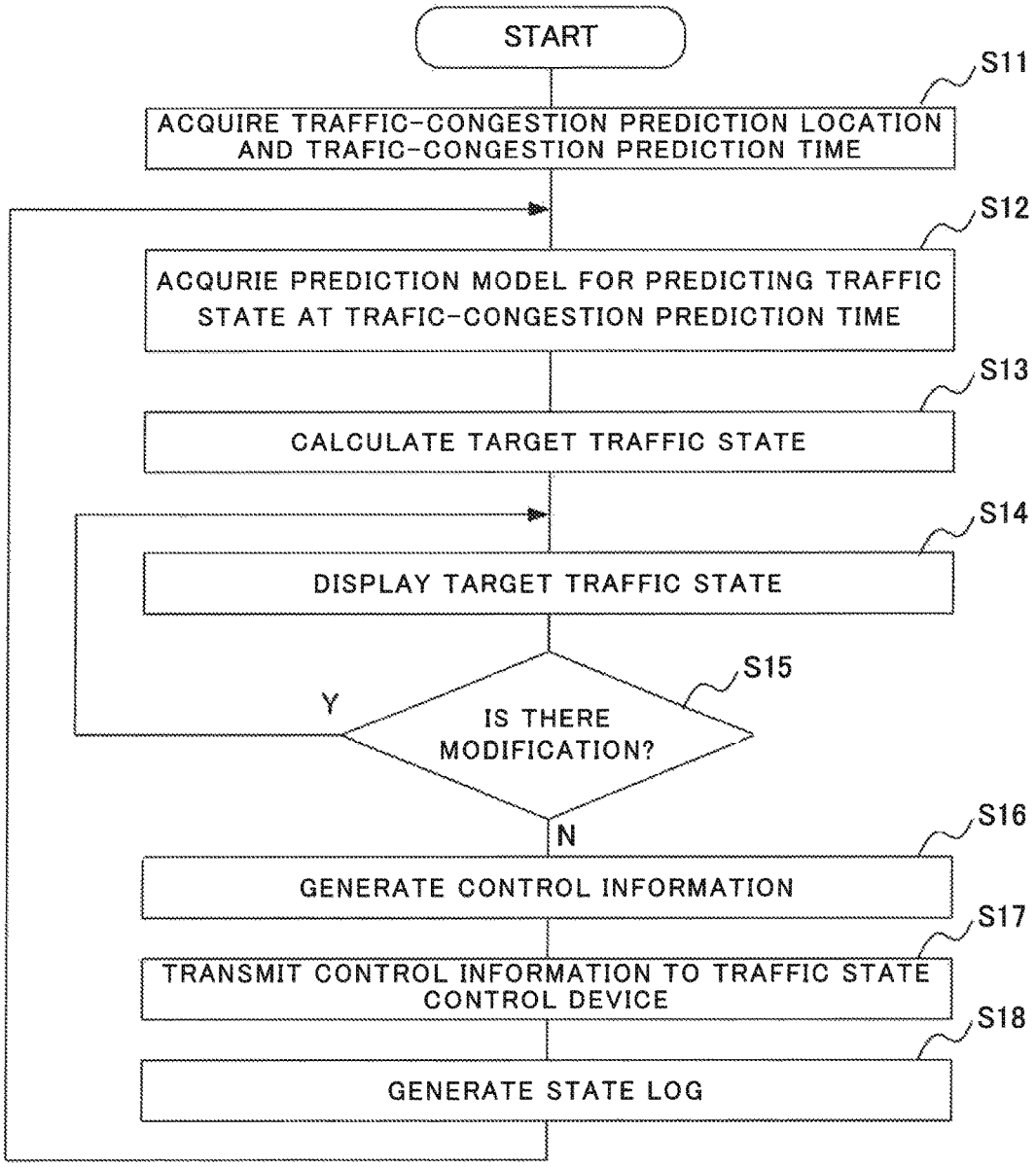
FIG. 4 is a flowchart illustrating traffic-congestion prevention processing in the first example embodiment of the present invention.

FIG. 4 is a flowchart illustrating traffic-congestion prevention processing in the first example embodiment of the present invention.

First, the traffic state calculation unit 124 of the prevention processing unit 12 acquires a traffic-congestion prediction location and a traffic-congestion prediction time from traffic-congestion prediction information (step S11).

For example, the traffic state calculation unit 124 acquires a traffic-congestion prediction location "X6" and a traffic-congestion prediction time "2015/08/01 12:00" (2 hours later) from the traffic-congestion prediction information for a current time "2015/08/01 10:00" of FIG. 7.

The traffic state calculation unit 124 acquires prediction models for predicting traffic states at the traffic-congestion prediction time for respective locations from the prediction model DB 122 (step S12).

For example, the traffic state calculation unit 124 acquires prediction models for predicting traffic states of 2 hours later (T=2 h) for respective locations from the prediction models of FIG. 6.

The traffic state calculation unit 124 calculates target traffic states at respective locations at the current time for preventing traffic congestion at the traffic-congestion prediction location at the traffic-congestion prediction time by using the acquired prediction models (step S13).

In step S13, the traffic state calculation unit 124 determines a solution of an optimization problem represented, for example, by an objective function of equation 2 and constraint functions of equation 3 and equation 4, and thereby calculates the target traffic states at respective locations.

$$\min_{\rho_i^*(t)} \sum_i c_i \times |\rho_i^*(t) - \rho_i(t)| \quad \text{[Equation 2]}$$

$$\text{subject to } \rho_j'(t+T) = \sum_i \alpha_{ij}\rho_i^*(t) \le \rho_j^{TH}, \forall j \quad \text{[Equation 3]}$$

$$|\rho_i^*(t) - \rho_i(t)| \le d_i^{MAX}, \forall i \quad \text{[Equation 4]}$$

In equation 2, $\rho^*_i(t)$ represents a target traffic state (vehicle density) at a location xi at a current time t, and $c_i$ represents a cost coefficient of the traffic state control device 30 disposed at the location xi. This objective function indicates that the target traffic state $\rho^*_i(t)$ at the current time is determined in such a way that a sum of values obtained by multiplying a difference (a control volume of a traffic state) between a measurement value of a traffic state at the current time t and the target traffic state for preventing traffic congestion by a cost coefficient is minimized.

Alternatively, as the objective function, an equation other than equation 2 may be used. For example, an equation regarding a difference between a traffic state at a previous time t−1 and the traffic state at the current time t may be used as the objective function, in order to prevent a traffic state at each location from oscillating. Alternatively, another objective function indicating a state that is allowable or preferable in road management, such as a combination of such an equation regarding difference of traffic states and equation 2, may be used.

Alternatively, instead of the cost coefficient, any cost function using a control volume as input may be defined for each location. Further, different cost coefficients or cost functions depending on a condition of a location, a time zone, and the like may be defined. Further, different cost functions depending on whether the control volume is positive or negative may be defined.

In equation 3, $\rho^{TH}_j$ represents a density threshold at a location xj. This constraint equation indicates that the target traffic states are constrained in such a way that, for all locations, a prediction value of a traffic states (a vehicle density) at the traffic congestion occurrence prediction time t+T is equal to or less than a density threshold. This constraint equation is set to avoid, as a result of preventing traffic congestion at the traffic-congestion prediction location, occurrence of traffic congestion at another location. Alternatively, instead of defining equation 3 for all locations, equation 3 may be defined for any one or more locations including the traffic-congestion prediction location.

While the prediction model that predicts a vehicle density at the prediction time from vehicle densities at the current time is used in equation 3, a prediction model that predicts a vehicle density at the prediction time from the other traffic states such as the number of passing vehicles or combinations of a plurality of traffic states, for example, may be used. Alternatively, as a constraint equation, another constraint condition indicating an allowable or preferable state in road management such as a traffic volume conservation constraint such that an entire traffic volume (the number of vehicles) on the road network is conserved even after being controlled may be added.

In equation 4, $d^{MAX}_i$ represents a maximum value of a controllable volume of a traffic state by the traffic state control device 30 disposed at a location xi. This constraint equation indicates that the target traffic states are constrained in such a way that, for all locations, the control volume is equal to or less than the maximum value of the controllable volume. When a minimum value of the controllable volume is defined, a similar constraint equation may be used for the minimum value. For these controllable volumes, different values depending on a condition of a location, a time zone, and the like may be defined. Alternatively, different controllable volumes depending on whether the control volume is positive or negative may be defined.

FIG. 11 is a diagram illustrating an example of a calculation result of target traffic states in the first example embodiment of the present invention.

For example, the traffic state calculation unit 124 calculates the target traffic states at respective locations as in FIG. 11 by using the prediction models acquired in step S12, the traffic states at the current time "2015/08/01 10:00" in FIG. 5, the density thresholds of FIG. 8, and the control means information of FIG. 9.

Next, the display control unit 16 generates a display screen 161 for displaying the target traffic states at respective locations and the like, and makes the display device 40 display the display screen 161 (step S14).

Figure 12:
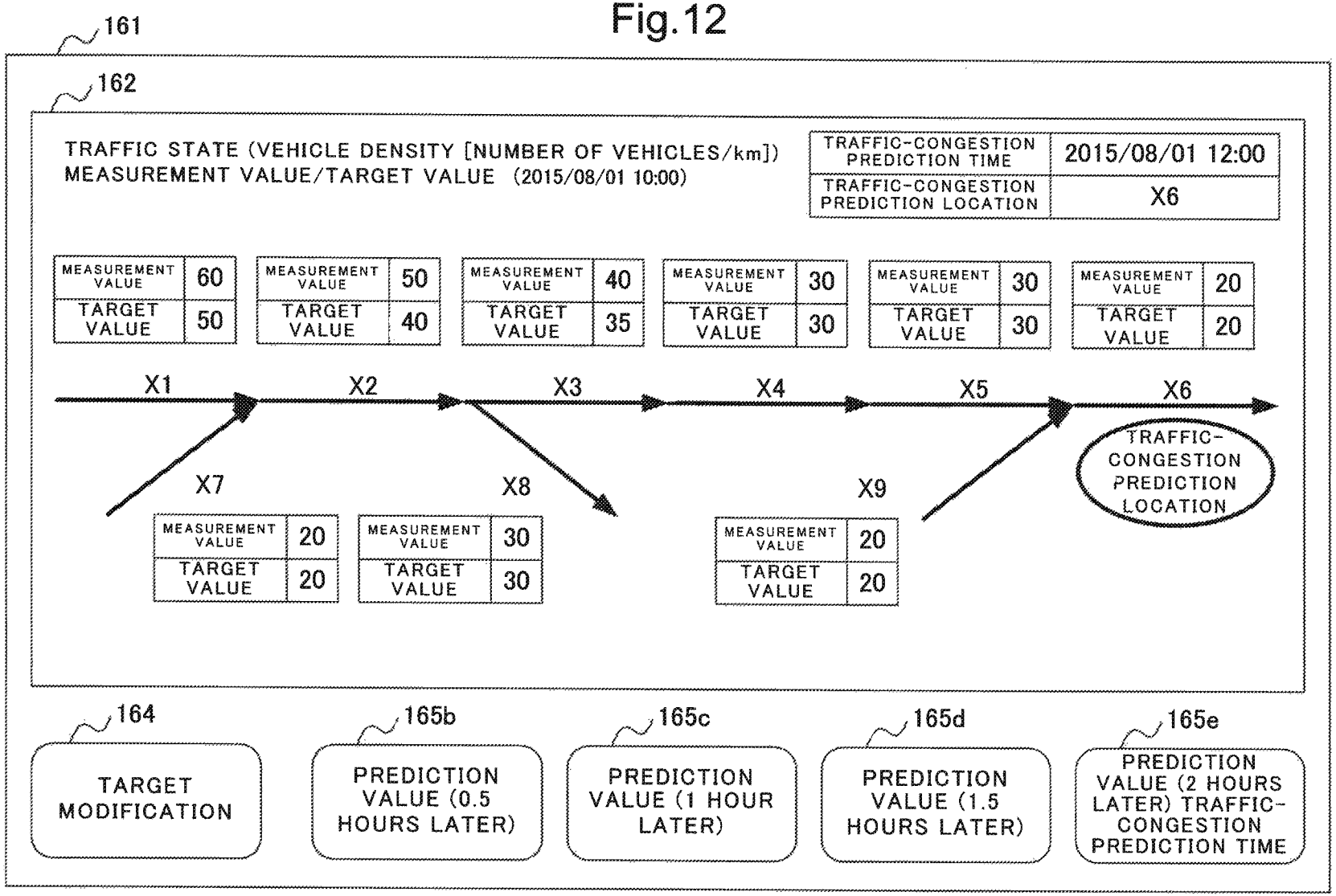
FIG. 12 is a diagram illustrating an example of a display screen 161 in the first example embodiment of the present invention.
Figure 13:
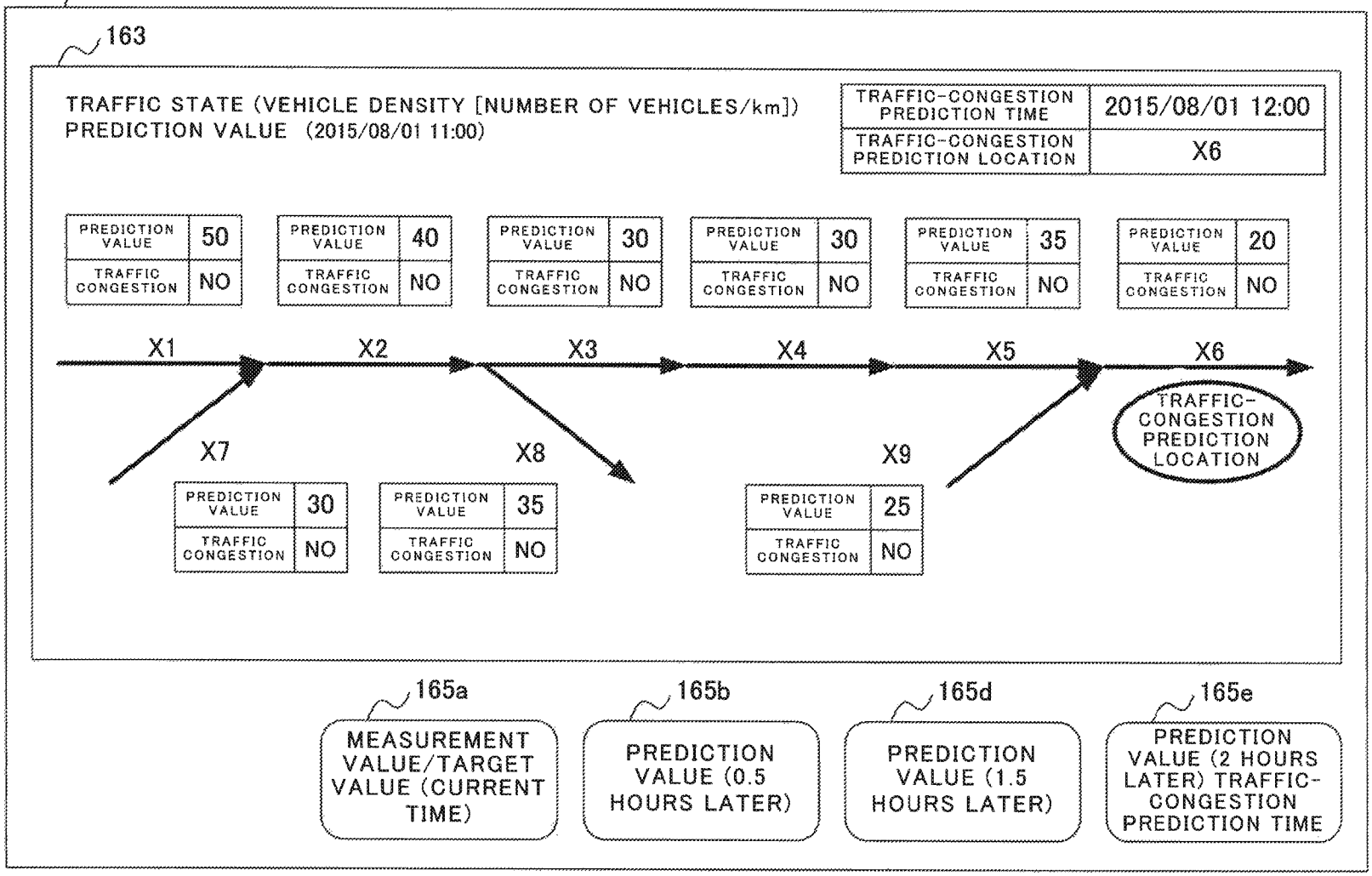
FIG. 13 is a diagram illustrating another example of the display screen 161 in the first example embodiment of the present invention.
Figure 14:
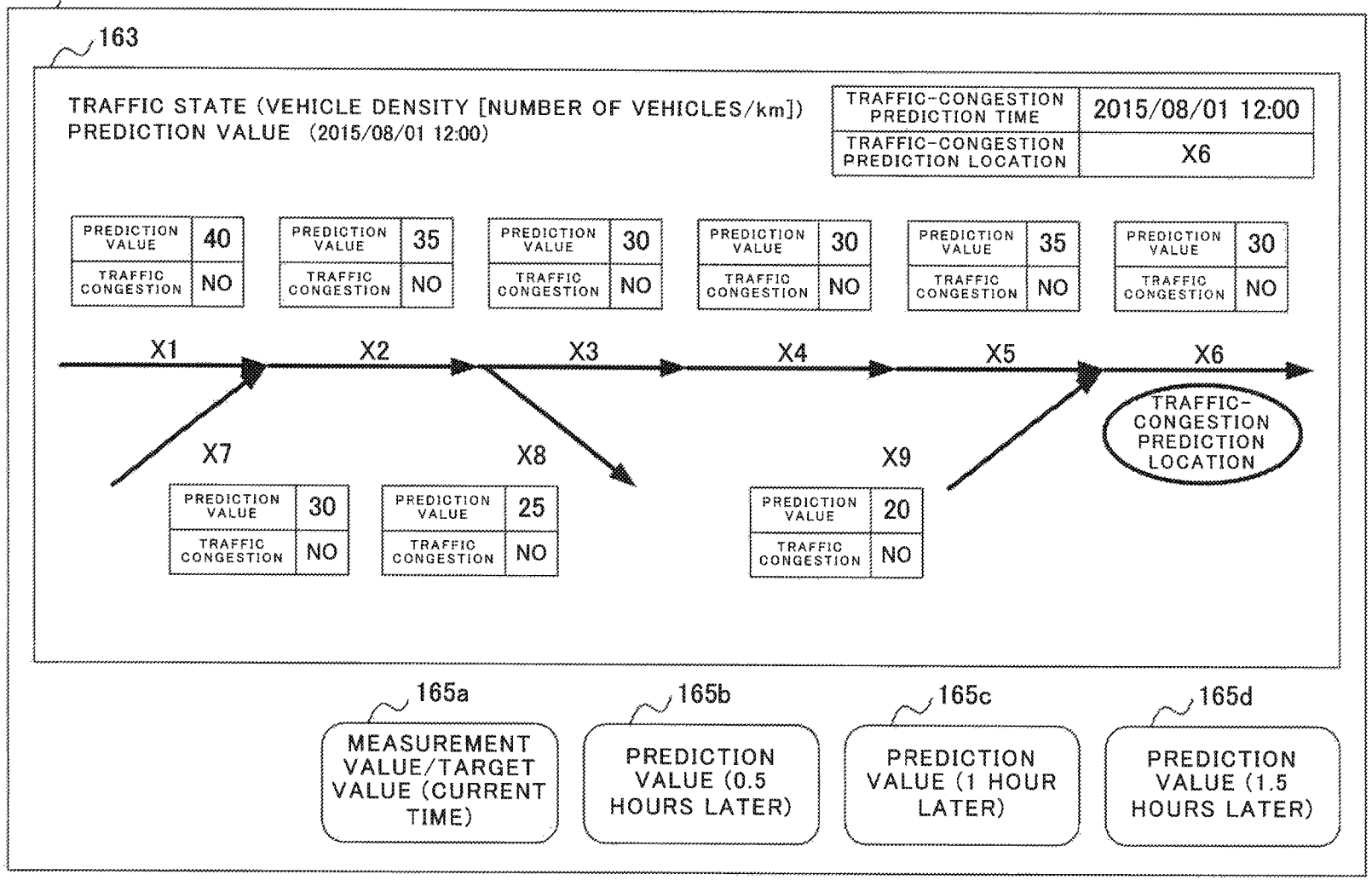
FIG. 14 is a diagram illustrating still another example of the display screen 161 in the first example embodiment of the present invention.

FIG. 12, FIG. 13, and FIG. 14 each are a diagram illustrating an example of the display screen 161 in the first example embodiment of the present invention. In the display screen 161 of FIG. 12, the traffic-congestion prediction time and the traffic-congestion prediction location regarding the traffic congestion to be prevented, measurement values of the traffic states at the current time and the target traffic states at respective locations are displayed in a traffic state display area 162. Further, in the display screen 161 of FIG. 13 and FIG. 14, the traffic-congestion prediction time, the traffic-congestion prediction location, and prediction values of traffic states and prediction results of traffic congestion occurrence of one hour later or two hours later in a case the target traffic states are set at respective locations at the current time are displayed, in a traffic state display area 163. These prediction values may be calculated by the traffic state calculation unit 124, for example, based on the target traffic states and the prediction models. Further, the prediction of traffic-congestion occurrence may be also performed by the traffic state calculation unit 124, for example, based on the prediction values of traffic states and the density thresholds. In the display screen 161 of FIG. 14, it is indicated that no traffic congestion occurs at the traffic-congestion prediction location (the location "X6") at the traffic-congestion time (2 hours later).

For example, the display control unit 16 makes the display device 40 display the display screens 161 illustrated in FIG. 12 to FIG. 14, according to an operation of switching buttons 165*a* to *e* by the operator.

Further, in addition to the target traffic states, control patterns of the control means at respective locations that are generated in step S16 described later may be displayed on the display screen 161.

The operator refers to the display screens 161 displayed on the display device 40 and thereby can confirm an effect of traffic-congestion prevention by control of traffic states at respective locations. Further, the operator refers to these display screens 161 and modifies (changes) the target traffic state when there is a problem in a value of the target traffic state or an effect of the traffic-congestion prevention. The operator, for example, overwrites the target traffic state on the display screen 161 and modifies the target traffic state by operating a modification button 164.

The instruction acceptance unit 17 accepts the modification of the target traffic state from the display device 40 (step S15).

In step S15, when the target traffic state is modified within a certain time after display of the display screen 161, for example (step S15/Y), the display control unit 16 executes processing from step S14 for the modified target traffic state.

Further, the instruction acceptance unit 17 may accept, other than the modification of the target traffic state, a modification regarding the objective function or the constraint equations for calculating the target traffic states. For example, the instruction acceptance unit 17 may accept a modification of the format of the objective function or a parameter such as the cost (the cost coefficient or the cost function) used in the objective function. Further, the instruction acceptance unit 17 may accept a modification of the format of the constraint equation or a parameter such as the density threshold and the controllable volume (a maximum value and a minimum value) of the traffic state used in the constraint equation. Further, the instruction acceptance unit 17 may accept a change of the prediction model.

When the modification regarding the objective function or the constraint equation is performed, processing from step S13 is executed.

In step S15, when any one of the target traffic states is not modified within a certain time after display of the display screen 161 or no modification is instructed, for example (step S15/N), the state control unit 132 of the control processing unit 13 generates control information for each location (step S16). In step S16, the state control unit 132 determines, for each location, a content of the control information for the target traffic state based on the control characteristic of the control model. When a type (e.g. a vehicle density) of the target traffic state and a type (e.g. a vehicle speed) of the traffic state represented by the control model are different from each other, the state control unit 132 may convert the type by using a measurement value or an estimation value of the traffic state or the like of another type (e.g. the number of passing vehicles), and determine the content of the control information.

FIG. 15 is a diagram illustrating an example of control information in the first example embodiment of the present invention. In the example of FIG. 15, as the control information for each location, a control pattern to be performed by the control means of the traffic state control device 30 is illustrated, with the target traffic state.

For example, the state control unit 132 generates, the control information illustrated in FIG. 15 for each of the target traffic states of FIG. 11 based on the control models of FIG. 10.

Next, the transmission unit 15 transmits the control information generated by the control processing unit 13 to the traffic state control device 30 at each location and instructs the traffic state control device 30 to perform control of the traffic state (step S17).

The traffic state control device 30 at each location performs the traffic control by the control means, in accordance with the control pattern in the control information.

For example, the traffic state control device 30 at the location X1 on the near side of and 50 kilometers from the traffic-congestion prediction location controls gates of a tollbooth in such a way that the number of passable gates becomes "two". The traffic state control device 30 at a location X2 on the near side of and 40 kilometers from the traffic-congestion prediction location controls driving support lamps in such a way that a lighting pattern becomes a "lighting pattern A". The traffic state control device 30 at a location X3 on the near side of and 30 kilometers from the traffic-congestion prediction location displays "presentation information A" on a guide board or the like.

Next, the log generation unit 18 generates a state log 181 indicating the target traffic states at respective locations and traffic states after performing the control (step S18). The log generation unit 18 stores the generated state log 181 on the log storage unit 19.

FIG. 16 is a diagram illustrating an example of the state log 181 in the first example embodiment of the present invention. In the state log 181 of FIG. 16, measurement values of the traffic states collected at a predetermined collection interval is recorded with the traffic-congestion prediction time, the traffic-congestion prediction location regarding the traffic congestion to be prevented, the time of performing the control, the control patterns at respective locations, and the target traffic states at respective locations.

For example, the log generation unit 18 generates the state log 181 illustrated in FIG. 16.

The log generation unit 18 displays the generated display state log 181 on the display device 40 in accordance with an instruction from the operator or the like. The operator refers to the state log 181 displayed on the display device 40 and thereby can confirm whether the control in accordance with the target traffic states is performed by the control means at respective locations. Similarly to step S15 described above, the instruction acceptance unit 17 may accept a modification of the target traffic state, a modification regarding the objective function or the constraint equations for calculating the target traffic states, and a change of the prediction model.

Thereafter, the processing of steps S12 to S18 is repeatedly executed, for example, at a predetermined control interval until the traffic-congestion prediction time.

For example, at a time "2015/08/01 10:30", the traffic-congestion prevention system 10 calculates the target traffic states at respective locations based on prediction models for 1.5 hours later (T=1.5 h) and the traffic states at the time, and controls the traffic states. Similarly, the traffic-congestion prevention system 10 controls the traffic states at times "2015/08/01 11:00" and "2015/08/01 11:30" based on prediction models for 1 hour later (T=1 h) and 0.5 hours later (T=0.5 h), respectively.

Figure 17:
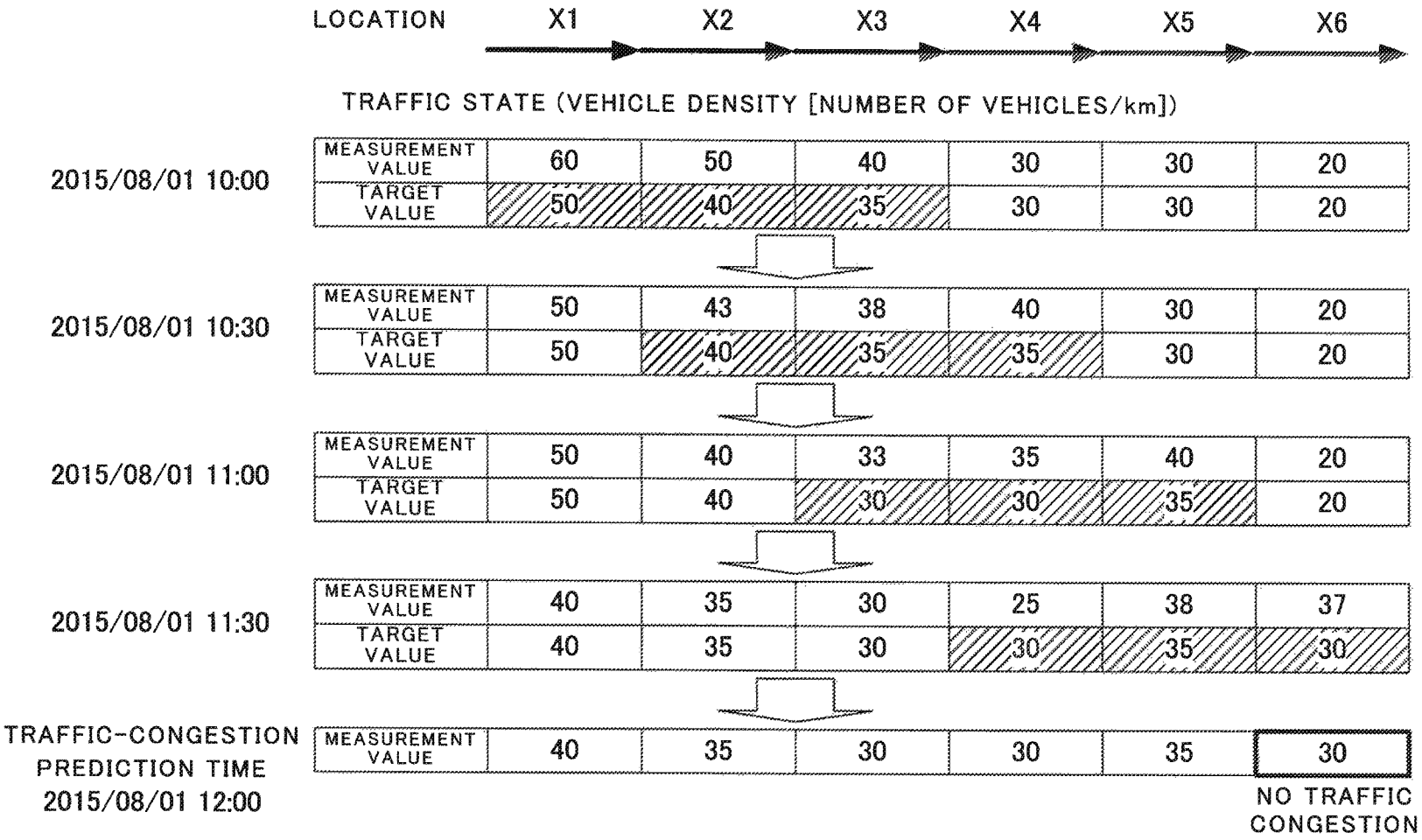
FIG. 17 is a diagram illustrating an example of traffic control in the first example embodiment of the present invention.

FIG. 17 is a diagram illustrating an example of traffic control in the first example embodiment of the present invention.

For example, as illustrated in FIG. 17, as the congestion-traffic prediction time approaches, the traffic states are appropriately controlled at locations closer to the traffic-congestion prediction location, and occurrence of the traffic congestion at the traffic-congestion prediction location at the traffic-congestion prediction time is prevented.

Note that, the instruction acceptance unit 17 may accept the modification of the target traffic state or the like at any timing during repeated execution of the processing of steps S12 to S18, without limitation to step S15.

In the above description, a case where the traffic states are controlled when the traffic congestion occurrence at the traffic-congestion prediction location at the traffic-congestion prediction time has been predicted is described. Alternatively, without limitation thereto, calculation of the target traffic states and control of the traffic states may be repeated in such a way that traffic congestion after a predetermined time at all locations or any one or more locations to be monitored/controlled does not occur.

In the above description, a case where the traffic states are controlled for one traffic congestion (one combination of a traffic-congestion predication time and a traffic-congestion prediction location) is described. Alternatively, without limitation thereto, the traffic states may be controlled for a plurality of traffic congestions (a plurality of combinations of a traffic-congestion predication time and a traffic-congestion prediction location). In this case, for example, the constraint equation of equation 3 is generated for the plurality of traffic congestions. Further, also in the display screen 161 and the state log 181, the traffic-congestion prediction times and traffic-congestion prediction locations regarding the plurality of traffic congestions are indicated.

In the above description, a case where a distance between locations to be monitored/controlled is 10 kilometers is described. However, without limitation thereto, as long as a traffic state at another location can be predicted from traffic states at respective locations, the distance between locations may be any distance such as several ten meters, several hundred meters, several kilometers, and several ten kilometers.

In the above description, a case where the traffic state calculation unit 124 determines a solution of the optimization problem represented by the objective function of equation 2 and the constraint equations of equation 3 and equation 4, and thereby calculates the target traffic states has been described. In other words, in order to prevent the traffic congestion at the target location at the target time, the target traffic states to be achieved at locations different from the target location are calculated. As the locations different from the target location, in equation 3, all locations (locations i) to be monitored/controlled are used, but as the locations different from the target location, locations where a traffic state has a high correlation with the target location between a current time and the target time may be selected and used. When, for example, in a freeway of a limiting speed of 80 kilometers per hour, a time difference between a current time and the target time is two hours, it is conceivable that traffic states at locations existing in a range to approximately 160 kilometers on the near side of the target location have a high correlation with the traffic state at the target location at the target time. Therefore, the target traffic states may be calculated and used for these locations existing in the range. Such a correlation is expressed as a weighting coefficient $\alpha_{ij}$ for the traffic state at each location used as an explanatory variable in the prediction model for the target location and the target time.

In a prediction model having high accuracy, for locations having no correlation, a very small weighting coefficient $\alpha_{ij}$ is obtained. In this case, target traffic states obtained for these locations have substantially the same values as current traffic states, and therefore locations having a high correlation as described above can be selected. When selecting locations having an explicitly high correlation, the optimization problem may be solved by deleting, from variables for optimization, target traffic states at locations having a weighting coefficient $\alpha_{ij}$ equal to or less than a certain value, and by using values of current traffic states as fixed values for these target traffic states, for example.

In the above description, a case where the traffic states at locations on the near side of the traffic-congestion prediction location in a traveling direction is controlled has been described. Alternatively, without limitation thereto, traffic states at every locations on the road network at which target traffic states are calculated by the traffic state calculation unit 124 may be controlled, by controlling traffic states of locations on the far side of the traffic-congestion prediction location of a traveling direction in addition to the locations on the near side of the traffic-congestion prediction location.

As described above, the operation of the first example embodiment of the present invention is completed.

Next, examples of the above-described control means will be described. As a control means included in the traffic state control device 30 at each location, for example, the following means are usable.

(1) Toll Control

In toll control, a usage toll at a specific location (section) is increased or decreased, and thereby a traffic volume flowing into the location (section) is controlled. In this case, as a control characteristic of a control model, for example, a relation between a toll and a traffic volume at each location (section) is described. Further, a plurality of control characteristics according to a calendar attribute such as a day of the week and a time zone are set. The state control unit 132 determines a toll associated with the target traffic state, based on such a control characteristic and sets the determined toll in control information.

(2) Control by Traveling-Type Driving Support Lamps

In control by traveling-type driving support lamps, a lighting pattern of illuminations such as LED (light emitting diode) illuminations disposed on a roadside is operated and thereby a traveling speed of a vehicle is controlled. In other words, the illuminations are lit in such a way as to travel parallel to a traveling vehicle, and a relative speed to the traveling vehicle is increased or decreased. Thereby, a sense a driver for the traveling speed is affected, and the traveling speed is controlled. For example, when light appears slow to the driver, an illusion such that the traveling speed is increased is given to the driver, and thus prompts the driver to reduce the speed. Conversely, when light appears fast to the driver, it is possible to prompt the driver to recover the speed. In a section where the traveling-type driving support lamps are disposed, the speed can be controlled at a fine time granularity. In this case, as a control characteristic, for example, a probability distribution of the speed affected by a lighting pattern, an expected value of the speed, an average value of the speed, or the like is set for a vehicle entering the section at a certain speed. The state control unit 132 determines a lighting pattern associated with the target traffic state, based on such a control characteristic, and sets the determined lighting pattern in control information.

(3) Control of Toll Gates

In control of toll gates, the total number of gates or the number of electronic toll collection system (ETC) gates of a toll booth is changed, and thereby a traffic volume flowing from the toll booth is controlled. When there are vehicles mounted with an ETC terminal at a certain ratio among vehicles passing through a toll booth, a traffic volume passing through the toll booth is proportional to the number of ETC gates. In other words, the number of vehicles passing through the toll booth per unit time increases as the number of ETC gates increases and decreases as the number of ETC gates decreases. Further, the total number of gates of the toll booth more directly affects the number of vehicles passing through the toll booth. In this case, as a control characteristic of a control model, for example, a relation between the total number of gates of the toll booth or the number of ETC gates thereof and a traffic volume is described. Further, the control characteristic may be set for each condition of a traffic volume of the toll booth and a ratio or an estimated volume of vehicles mounted with an ETC terminal among the traffic volume. In order to change the total number of gates or the number of ETC gates of the toll booth, there are cost factors such as necessity of direct work by persons and difficulty of a change until a traffic volume thins out, and therefore these cost factors may be reflected in the cost in the control model. The state control unit 132 determines the total number of gates or the number of ETC gates associated with the target traffic state, based on such a control characteristic, and sets the determined number in control information.

(4) Control of an Opening-Closing Timing of an ETC Gate

In control of an opening-closing timing of an ETC gate, operation settings (an opening-closing timing and an opening-closing speed) of a gate bar are changed, and thereby a traffic volume passing through a toll booth is controlled. A driver of a vehicle passing through the ETC gate controls a traveling speed while confirming an opening-closing situation of the gate. Therefore, according to a time (timing) from entry of the vehicle into the toll booth and decision of opening the gate bar to a start of raising the bar, or an opening-closing speed of the bar, a vehicle speed around the gate is changed. An operation of the gate bar is performed by a machine, and therefore a setting can be changed at a fine time granularity. In this case, as a characteristic of a control model, for example, a relation between a time for passing through the toll booth or a distance between vehicles (a distance associated with a traffic volume) for an approach speed to the ETC gate and an operation setting (an opening-closing timing or an opening-closing speed) of the gate bar is described. Alternatively, as a control characteristic, a traffic volume passing through the toll booth for the operation setting of the gate bar may be described. The state control unit 132 determines operation setting of the gate bar associated with the target traffic state, based on such a control characteristic and sets the determined settings in control information.

(5) Guidance Control to an SA (Service Area)/PA (Parking Area)

In guidance control to an SA/PA, a driver or a passenger is prompted to use an SA or PA, and thereby a traffic volume is controlled. When a vehicle uses an SA or PA, the vehicle goes off the road, and therefore the number of vehicles existing on the road can be reduced. A guidance means to an SA/PA includes a guide board disposed on a road, information presentation to a terminal mounted on a vehicle, information presentation to a mobile terminal held by the driver or the passenger, and the like. Contents of information to be presented include information for directly prompting such as explicit presentation of a purpose for traffic-congestion prevention and information for indirectly prompting regarding a campaign or an incentive by a shop in the SA/PA. In this case, as a control characteristic of a control model, for example, a relation between presentation information and a ratio of vehicles used the SA/PA in accordance with the presentation information is described. The state control unit 132 determines presentation information associated with the target traffic state, based on such a control characteristic, and sets the determined information in control information.

(6) Control by Presentation Information to an Information Board

In control by presentation information to an information board, a traffic volume is controlled by information displayed on the information board disposed on a road. Information displayable on the information board can be displayed by characters while an amount thereof is limited. Therefore, by the information displayed on the information board, various types of guidance for a driver are possible. Contents displayed on the information board include a content for prompting the driver to increase or reduce speed, a content for prompting the driver to refrain from changing a lane, and the like, due to predicted traffic congestion. In this case, as a control characteristic of a control model, for example, a relation between a display content and a ratio of vehicles followed the content is described. The state control unit 132 determines a display content associated with the target traffic state, based on such a control characteristic and sets the determined content in control information.

(7) Control by a Pace Maker

In control by a pace maker, a patrol vehicle, a maintenance vehicle, and the like possessed by a road management company and the like are used as a pace maker vehicle, and thereby a traffic state is controlled. These vehicles are under control of the road management company, and therefore a speed and a driving behavior as instructed can be realized. For example, the pace maker vehicle is instructed to drive in such a way as to strictly observe speed limit or to drive at a speed slightly lower than the speed limit, and thereby behavior of the following vehicles can be controlled to some extent. Further, by combining an original purpose of the pace maker vehicle such as patrol and a move to a maintenance place with the control of the traffic state, the traffic state can be controlled without increasing a cost. In this case, as a control characteristic of a control model, for example, a relation between a driving pattern of the pace maker vehicle and an influence of the driving pattern on another vehicle around the pace maker vehicle is described. The state control unit 132 determines a driving pattern associated with the target traffic state, based on such a control characteristic, and sets the determined pattern in control information.

(8) Control by an Autonomous Vehicle

In control by an autonomous vehicle, by prompting an autonomous vehicle to switch a traveling pattern such as a vehicle speed and a distance between vehicles, and thereby a traffic state is controlled. The autonomous vehicle may be, for example, a vehicle that is completely automatically drivable without human operations. Alternatively, the autonomous vehicle may be, for example, a vehicle that is partially automatically drivable by a preceding vehicle following travel function (cruise control) or the like. In the case of a vehicle mounted with the cruise control, by changing a setting of the preceding vehicle following, i.e. a following distance, a reaction speed, or the like, a traveling pattern can be controlled. Further, some vehicles can realize a traveling pattern to some extent even when there is no preceding vehicle. Such control of the traveling pattern can be used in a large number of vehicles due to spread of vehicles mounted with an automated driving technique, and a significant effect is expected. Further, when platooning travelling can be configured by a vehicle group including vehicles mounted with the cruise control function, an influence of the vehicle group on the following vehicles is large, and therefore a traffic volume controllable by a traveling pattern can be increased. In this case, as a control characteristic of a control model, for example, a relation between a traveling pattern and an influence of the traveling pattern on a traffic volume around the autonomous vehicle is described. The control characteristic may be set in association with the traffic volume around the autonomous vehicle. The state control unit 132 determines a traveling pattern associated with the target traffic state and a vehicle to be applied with the traveling pattern, based on such a control characteristic, and sets the determined traveling pattern and vehicle in control information.

Note that, as long as a traffic state can be controlled, another control means such as control of a traffic signal may be used.

Further, in the above description, a case where there is one type of control means at each location and the traffic state calculation unit 124 calculates the target traffic states by using the objective function taking account of a cost of the control means at each location has been described. However, without limitation thereto, when there is a plurality of control means at each location, the state control unit 132 may select a combination of one or more control means at each location. In this case, the state control unit 132 preferentially selects, for example, a control means by which only a small control volume is obtained but an effect is produced in a short time. With regard to a difference between a traffic state acquired by the selected means and the target traffic state, the state control unit 132 may further select a control means, such as toll control, which takes longer time to produce an effect but by which a large control volume is obtained. Alternatively, the state control unit 132 may select a control means, based on a control model and constraint of each control means, in such a way that a probability of achieving the target traffic state is high and a cost for changing the traffic state is low.

Figure 18:
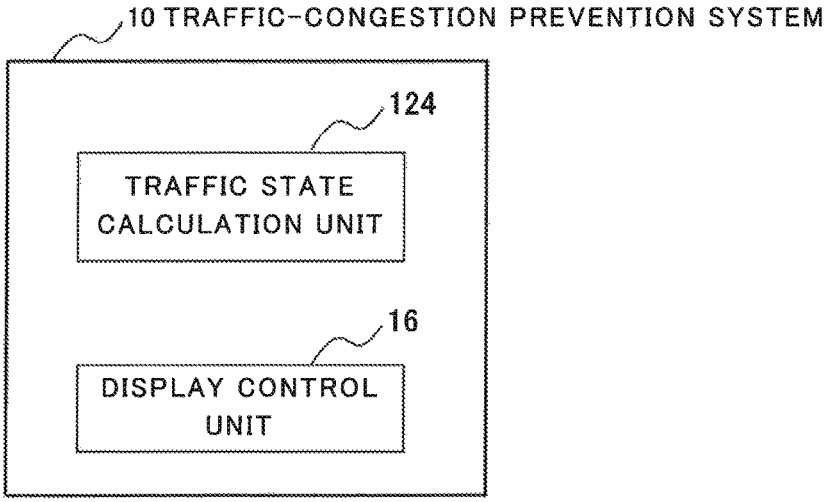
FIG. 18 is a block diagram illustrating a characteristic configuration of the first example embodiment of the present invention.

Next, a characteristic configuration of the first example embodiment of the present invention will be described. FIG. 18 is a block diagram illustrating a characteristic configuration of the first example embodiment of the present invention. Referring to FIG. 18, a traffic-congestion prevention system 10 includes a traffic state calculation unit 124 (a calculation unit) and a display control unit 16. The traffic state calculation unit 124 calculates a target traffic state that is a traffic state to be achieved at a location different from a target location in order to prevent traffic congestion at the target location at a target time. The display control unit 16 controls display means in such a way that the target traffic state at the location is displayed on the display means.

Figure 19:
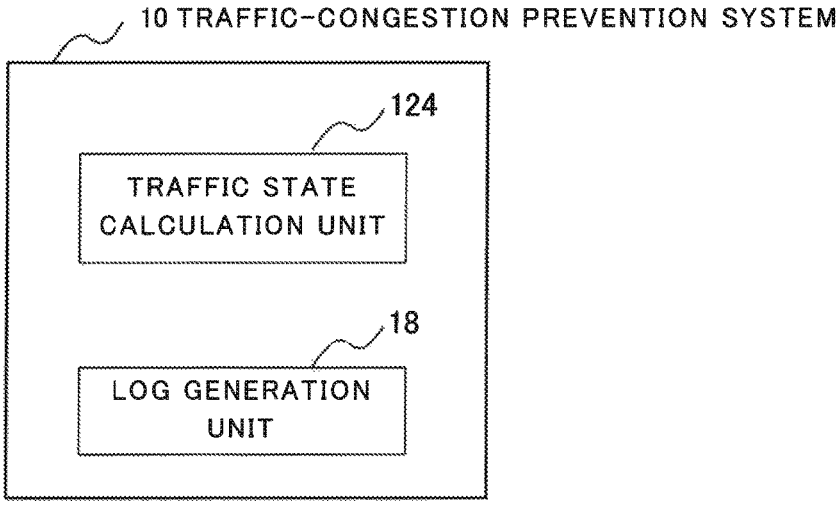
FIG. 19 is a block diagram illustrating another characteristic configuration of the first example embodiment of the present invention.

FIG. 19 is a block diagram illustrating another characteristic configuration of the first example embodiment of the present invention. Referring to FIG. 19, a traffic-congestion prevention system 10 includes a traffic state calculation unit 124 (a calculation unit) and a log generation unit 18. The traffic state calculation unit 124 calculates a target traffic state that is a traffic state to be achieved at a location different from a target location in order to prevent traffic congestion at the target location at a target time. The log generation unit 18 generates and outputs a log indicating the target traffic state at the location and a measurement value of the traffic state at the location Next, advantageous effects of the first example embodiment of the present invention will be described. According to the first example embodiment of the present invention, it is possible to prevent traffic congestion more certainly at a target location at a target time. The reason is that the traffic state calculation unit 124 calculates, in order to prevent traffic congestion at the target location at the target time, a target traffic state that is a traffic state to be achieved at a location different from the target location. By controlling a traffic state at each location using the calculated target traffic state, control is performed at locations in wide area, and traffic congestion can be more certainly prevented compared with a case where control is performed locally even when a control volume of the traffic state at each location is small.

Further, according to the first example embodiment of the present invention, an operator or the like can adjust a system in such a way as to more certainly prevent traffic congestion. The reason is that the display control unit 16 controls display means in such a way that the target traffic state at each location is displayed on the display means, or the log generation unit 18 generates and outputs a log indicating the target traffic state and a measurement value of the traffic state at each location. Thereby, the operator can change a value of the target traffic state, a format or a parameter of an objective function or a constraint equation for calculating the target traffic state, and a prediction model, in such a way as to set a more appropriate target traffic state.

(Second Example Embodiment)

Next, a second example embodiment of the present invention will be described.

The second example embodiment of the present invention is different from the first example embodiment of the present invention in that a prediction model predicts a traffic state at a prediction location at a prediction time from, in addition to traffic states at a current time at respective locations, prediction values of the traffic states at a future time at respective locations.

In the second example embodiment of the present invention, a prediction model as in equation 5 is used.

$$\rho'_j(t_0+T) = \sum_k \sum_i \beta_{k,ij}\rho_i(t_0+t_k) + \sum_i \alpha_{ij}\rho_i(t) + \sum_l \sum_i \gamma_{l,ij}\rho'_i(t_0+t_l) \quad \text{(where } t_0 < t_0+t_k < t < t_0+t_l < t_0+T\text{)} \qquad \text{[Equation 5]}$$

wherein $t_0$ represents a time of a starting point, $t_0+t_k$ (k=1, 2, . . . , $M_k$; $M_k$ is an integer equal to or more than 1) represents a past time between the starting point time $t_0$ and a current time t, and $t_0+t_1$ (l=1, 2, . . . , $M_1$; $M_1$ is an integer equal to or more than 1) represents a future time between the current time t and the prediction time $t_0+T$. Further, $\alpha_{ij}$, $\beta_{k,ij}$, and $\gamma_{1,ij}$ are parameters by which $\rho_i(t)$, $\rho_i(t_0+t_k)$, and $\rho'_i(t_0+t_1)$ are multiplied, respectively.

In the first term, the second term, and the third term of the right side of equation 5, traffic states at the past time, traffic states at the current time, and traffic states at the future time are used as explanatory variables, respectively. The prediction value $\rho'_i(t_0+t_1)$ is calculated by a prediction model that predicts a traffic state of $t_1$ hours later, based on a traffic state at the time $t_0$. The prediction value $\rho'_i(t_0+t_1)$ may be collected, by the reception unit 11, from another device such as the traffic-congestion prediction device 20, and stored on the traffic state DB 14.

The traffic state calculation unit 124 determines, in step S13 described above, a solution of an optimization problem represented by an objective function of equation 6 and constraint equations of equation 7 and equation 8, and thereby calculates target traffic states at respective locations.

$$\min_{\rho_i^*(t),\rho_l^*(t_0+t_l)} \sum_i c_i \times |\rho_i^*(t) - \rho_i(t)| + \sum_l \sum_i c_i \times |\rho_i^*(t_0+t_l) - \rho'_i(t_0+t_l)| \qquad \text{[Equation 6]}$$

$$\text{subject to } \rho'_j(t_0+T) = \sum_k \sum_i \beta_{k,ij}\rho_i(t_0+t_k) + \sum_i \alpha_{ij}\rho_i^*(t) + \sum_l \sum_i \gamma_{l,ij}\rho_i^*(t_0+t_l) \le \rho^{TH},\ \forall\ j \qquad \text{[Equation 7]}$$

$$|\rho_i^*(t) - \rho_i(t)| \le d_i^{MAX},\ |\rho_i^*(t_0+t_l) - \rho_i(t_0+t_l)| \le d_i^{MAX},\ \forall\ i \qquad \text{[Equation 8]}$$

The objective function of equation 6 indicates that target traffic states $\rho^*_i(t)$ and $\rho^*_i(t_0+t_1)$ at the current time t and the future time $t_0+t_1$ are determined, respectively, in such a way that a sum of values obtained by multiplying a control volume of a traffic state at the current time t by a cost coefficient and values obtained by multiplying an anticipated control volume of the traffic state at the future time $t_0+t_1$ by a cost coefficient is minimized.

In this manner, the target traffic states for preventing traffic congestion are calculated based on prediction models using, as explanatory variables, traffic states at a plurality of times including a future time, and thereby, the traffic states can be controlled by taking care of not only a control volume of the traffic state at a current time but also an anticipated control volume in the future. Therefore, traffic congestion can be prevented with a less control volume, compared with a case where only control for traffic states at a current time is taken care of.

Note that, in the objective function of equation 6, as a cost, a cost coefficient for each location is used, but similarly to the first example embodiment, different cost coefficients or cost functions depending on a condition such as a time zone may be defined. Further, it is conceivable that the anticipated control volume at a future time includes a larger error resulting from a prediction error with an increase in a time difference between the current time and the future time. Therefore, in the objective function of equation 6, a cost depending on a future time such that the cost is increased as a time difference between the current time and the future time is increased may be used.

According to the second example embodiment of the present invention, traffic congestion can be prevented with a less control volume, compared with the first example embodiment of the present invention. The reason is that the traffic state calculation unit 124 calculates a target traffic state by using a prediction model that predicts a traffic state at a target location at a target time from traffic states at respective locations at a current time and prediction values of the traffic states after the current time and before the target time.

While the present invention has been particularly shown and described with reference to the example embodiments thereof, the present invention is not limited to the embodiments. It will be understood by those of ordinary skill in the art that various changes in form and details may be made therein without departing from the spirit and scope of the present invention as defined by the claims.

REFERENCE SIGNS LIST

10 Traffic-congestion prevention system
101 CPU
102 Storage device
103 Input/output device
104 Communication device
11 Reception unit
12 Prevention processing unit
121 Prediction information DB
122 Prediction model DB
123 Control means DB
124 Traffic state calculation unit
125 Diagram storage unit
13 Control processing unit
131 Control model DB
132 State control unit
14 Traffic state DB
15 Transmission unit
16 Display control unit
161 Display screen
162 Traffic state display area
163 Traffic state display area
164 Modification button
165 Switching button
17 Instruction acceptance unit
18 Log generation unit
181 State log
19 Log storage unit
20 Traffic-congestion prediction device
30 Traffic state control device
40 Display device

What is claimed is:

1. A traffic-congestion prevention system comprising:
a memory storing instructions; and
one or more processors configured to execute the instructions to:
calculate a target traffic state to be achieved at a current time, for each of a plurality of locations different from a traffic-congestion prediction location where occurrence of traffic congestion at a future time is predicted at the current time, in order to prevent the occurrence of the traffic congestion at the future time; and
display the target traffic state on display means,
wherein
the target traffic state is displayed on the display means to be referred to by an operator of road management,
the one or more processors configured to further execute the instructions to accept, from the operator, at least one of a modification instruction for the target traffic state displayed on the display means, a modification instruction for a function or a constraint equation for calculating the target traffic state, and a change instruction of a prediction model, and generate control information for realizing the target traffic state for each of the plurality of locations, and
the target traffic state is at least one of a vehicle density and a number of passing vehicles per unit time to be achieved at a time, before a traffic-congestion prediction time at which occurrence of the traffic congestion is predicted, in order to prevent the traffic congestion.

2. The traffic-congestion prevention system according to claim 1, wherein
the one or more processors configured to further execute the instructions to determine a traveling pattern of an autonomous vehicle associated with the target traffic state and a vehicle to be applied with the traveling pattern, and set the determined traveling pattern and vehicle to the control information.

3. A traffic-congestion prevention system comprising:
a memory storing instructions; and
one or more processors configured to execute the instructions to:
calculate a target traffic state to be achieved at a current time, for each of a plurality of locations different from a traffic-congestion prediction location where occurrence of traffic congestion at a future time is predicted at the current time, in order to prevent the occurrence of the traffic congestion at the future time; and
generate control information for realizing the target traffic state for each of the plurality of locations,
wherein
the target traffic state is displayed on a display means to be referred to by an operator of road management,
the one or more processors configured to further execute the instructions to accept, from the operator, at least one of a modification instruction for the target traffic state displayed on the display means, a modification instruction for a function or a constraint equation for calculating the target traffic state, and a change instruction of a prediction model, and generate control information for realizing the target traffic state for each of the plurality of locations, and
the target traffic state is at least one of a vehicle density and a number of passing vehicles per unit time to be achieved at a time, before a traffic-congestion prediction time at which occurrence of the traffic congestion is predicted, in order to prevent the traffic congestion.

4. The traffic-congestion prevention system according to claim 3, wherein the one or more processors configured to further execute the instructions to transmit the control information to traffic state control means.

5. The traffic-congestion prevention system according to claim 3, wherein, as a traffic-congestion prediction time at which occurrence of the traffic congestion is predicted approaches, a location for performing control of a traffic state is changed from a location far from the traffic-congestion prediction location to a location close to the traffic-congestion prediction location among the plurality of locations.

6. The traffic-congestion prevention system according to claim 3, wherein the target traffic state is calculated by using a prediction model for predicting a traffic state at the traffic-congestion prediction location at a traffic-congestion prediction time from traffic states at the plurality of locations.

7. The traffic-congestion prevention system according to claim 6, wherein the target traffic state is calculated by using the prediction model for predicting the traffic state at the traffic-congestion prediction location at the traffic-congestion prediction time, from traffic states at a current time and prediction values of traffic states after the current time and before the traffic-congestion prediction time at the plurality of locations.

8. The traffic-congestion prevention system according to claim 3, wherein the target traffic states at the plurality of locations are calculated in such a way that a cost for achieving the target traffic states at the plurality of locations is minimized.

9. A traffic-congestion prevention system comprising:

a memory storing instructions; and one or more processors configured to execute the instructions to:

calculate a target traffic state to be achieved at a current time, for each of a plurality of locations different from a traffic-congestion prediction location where occurrence of traffic congestion at a future time is predicted at the current time, in order to prevent the occurrence of the traffic congestion at the future time; and generate a log including the target traffic state and a measurement value of a traffic state at each of the plurality of locations, wherein the target traffic state is displayed on a display means to be referred to by an operator of road management, the one or more processors configured to further execute the instructions to accept, from the operator, at least one of a modification instruction for the target traffic state displayed on the display means, a modification instruction for a function or a constraint equation for calculating the target traffic state, and a change instruction of a prediction model, and generate control information for realizing the target traffic state for each of the plurality of locations, and the target traffic state is at least one of a vehicle density and a number of passing vehicles per unit time to be achieved at a time, before a traffic-congestion prediction time at which occurrence of the traffic congestion is predicted, in order to prevent the traffic congestion.

10. The traffic-congestion prevention system according to claim 9, wherein the log including the control information is generated.

11. The traffic-congestion prevention system according to claim 10, wherein the one or more processors configured to further execute the instructions to transmit the control information to traffic state control means.

12. The traffic-congestion prevention system according to claim 10, wherein the log indicating traffic states after performing control at the plurality of locations is generated.

13. A traffic-congestion prevention method comprising:

calculating a target traffic state to be achieved at a current time, for each of a plurality of locations different from a traffic-congestion prediction location where occurrence of traffic congestion at a future time is predicted at the current time, in order to prevent the occurrence of the traffic congestion at the future time;

displaying the target traffic state on display means to be referred to by an operator of road management; and accepting, from the operator, at least one of a modification instruction for the target traffic state displayed on the display means, a modification instruction for a function or a constraint equation for calculating the target traffic state, and a change instruction of a prediction model, and generating control information for realizing the target traffic state for each of the plurality of locations, wherein the target traffic state is at least one of a vehicle density and a number of passing vehicles per unit time to be achieved at a time, before a traffic-congestion prediction time at which occurrence of the traffic congestion is predicted, in order to prevent the traffic congestion.

14. A non-transitory computer readable storage medium recording thereon a program causing a computer to perform a method comprising:

calculating a target traffic state to be achieved at a current time, for each of a plurality of locations different from a traffic-congestion prediction location where occurrence of traffic congestion at a future time is predicted at the current time, in order to prevent the occurrence of the traffic congestion at the future time; and displaying the target traffic state on display means to be referred to by an operator of road management; and accepting, from the operator, at least one of a modification instruction for the target traffic state displayed on the display means, a modification instruction for a function or a constraint equation for calculating the target traffic state, and a change instruction of a prediction model, and generating control information for realizing the target traffic state for each of the plurality of locations, wherein the target traffic state is at least one of a vehicle density and a number of passing vehicles per unit time to be achieved at a time, before a traffic-congestion prediction time at which occurrence of the traffic congestion is predicted, in order to prevent the traffic congestion.

15. The traffic-congestion prevention system according to claim 1, wherein the one or more processors are further configured to execute the instructions to:

calculate a predicted value of a traffic state at each time until the future time for each of the plurality of locations, in a case that the target traffic state is set for each of the plurality of locations, and display the predicted value of the traffic state at each time until the future time for each of the plurality of locations.

* * * * *